US008013777B2

(12) United States Patent
Sim et al.

(10) Patent No.: US 8,013,777 B2
(45) Date of Patent: Sep. 6, 2011

(54) ELECTROMAGNETIC WAVE ABSORBER USING RESISTIVE MATERIAL

(75) Inventors: Dong-Uk Sim, Daejeon (KR); Jong Hwa Kwon, Daejeon (KR); Sang Il Kwak, Daejeon (KR); Hyung Do Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 220 days.

(21) Appl. No.: 12/207,818

(22) Filed: Sep. 10, 2008

(65) Prior Publication Data

US 2009/0284404 A1 Nov. 19, 2009

(30) Foreign Application Priority Data

May 14, 2008 (KR) ..... 10-2008-0044515

(51) Int. Cl.
*H01Q 17/00* (2006.01)

(52) U.S. Cl. ..... 342/1; 342/4

(58) Field of Classification Search ..... 342/1, 2, 342/3, 4

See application file for complete search history.

(56) References Cited

U.S. PATENT DOCUMENTS 2,875,435 A * 2/1959 McMillan ..... 342/1
4,012,738 A * 3/1977 Wright ..... 342/1
4,479,994 A * 10/1984 Berg ..... 428/195.1
4,972,191 A * 11/1990 Ishino et al. ..... 342/1
5,095,311 A * 3/1992 Sajiki et al. ..... 342/1
5,325,094 A * 6/1994 Broderick et al. ..... 342/1
5,510,792 A * 4/1996 Ono et al. ..... 342/4
5,576,710 A * 11/1996 Broderick et al. ..... 342/1
5,617,096 A * 4/1997 Takahashi ..... 342/4
5,808,350 A * 9/1998 Jack et al. ..... 257/440
6,225,939 B1 * 5/2001 Lind ..... 342/4
6,504,501 B2 * 1/2003 Tsuno et al. ..... 342/1
6,538,596 B1 3/2003 Gilbert
7,256,753 B2 * 8/2007 Werner et al. ..... 343/909

(Continued)

FOREIGN PATENT DOCUMENTS

JP 2001-320191 A 11/2001
JP 2008034651 A * 2/2008

OTHER PUBLICATIONS

Hang Wang; Wei Tang; Zhongxiang Shen; , "On the Design of Radar Absorbing Materials Using Left-Handed Transmission Line," Microwave Symposium, 2007. IEEE/MTT-S International. pp. 1475-1478, Jun. 3-8, 2007.*

(Continued)

*Primary Examiner* — Thomas Tarcza
*Assistant Examiner* — Matthew M Barker
(74) *Attorney, Agent, or Firm* — Rabin & Berdo, P.C.

(57) ABSTRACT

An electromagnetic wave absorber includes a ground layer made of a metal conductor, a dielectric layer formed on the ground layer, and a unit cell pattern made of a resistive material, and formed on the dielectric layer. The unit cell pattern includes a fundamental patch having a regular square shape, in which a rectangular recess is formed on the center of each of the respective sides, the fundamental patch being located at the center of each of the unit cell pattern, and half cross dipole patches, which are respectively disposed at the four sides of the fundamental patch at a regular angle so as to be engaged with the recesses formed on the respective sides of the fundamental patch at a regular interval.

18 Claims, 9 Drawing Sheets

U.S. PATENT DOCUMENTS

| | | | | |
|---|---|---|---|---|
| 7,495,181 | B2 * | 2/2009 | Matsushita et al. | 174/377 |
| 7,679,563 | B2 * | 3/2010 | Werner et al. | 343/700 MS |
| 2001/0032701 | A1 * | 10/2001 | Kawanaka et al. | 156/276 |
| 2004/0263420 | A1 * | 12/2004 | Werner et al. | 343/909 |
| 2007/0222658 | A1 * | 9/2007 | Puscasu et al. | 342/1 |
| 2007/0247349 | A1 * | 10/2007 | Masuda et al. | 342/4 |
| 2008/0212304 | A1 * | 9/2008 | Masuda et al. | 361/818 |
| 2010/0090879 | A1 * | 4/2010 | Janis | 342/1 |
| 2010/0097048 | A1 * | 4/2010 | Werner et al. | 324/76.11 |

OTHER PUBLICATIONS

A Genetic Algorithm Approach to the Design of Ultra-Thin Electromagnetic Bandgap Absorbers, D. J. Kern and D. H. Werner, Microwave and Optical Technology Letters vol. 38, No. 1, Jul. 5, 2003.

Application of metamaterials to ultra-thin radar-absorbing material design, Q. Gao, Y. Yin, D.-B. Yan and N.-C. Yuan, Electronics Letters vol. 41 No. 17, Aug. 18, 2005.

* cited by examiner

ELECTROMAGNETIC WAVE ABSORBER USING RESISTIVE MATERIAL

CROSS-REFERENCE(S) TO RELATED APPLICATIONS

The present invention claims priority of Korean Patent Application No. 10-2008-0044515, filed on May 14, 2008, which is incorporated herein by reference.

FIELD OF THE INVENTION

The present invention relates to a resonant electromagnetic wave absorber using a resistive material, and more particularly to an electromagnetic wave absorber made of a resistive material, in which the whole pattern, obtained by periodically arranging unit cells, properly adjusts the phases of reflected waves and transmitted waves using an Electromagnetic BandGap (EBG) structure so as to absorb electromagnetic waves.

This work was supported by the IT R&D program of MIC/IITA[2007-F-043-01, Study on Diagnosis and Protection Technology based on EM]

BACKGROUND OF THE INVENTION

As information technology (IT) has been rapidly developed and a desire for Internet communication has been increased, wireless communication instruments including a portable terminal become necessary articles for the present age. However, as portable instruments have been increasingly used, the influence of electromagnetic waves generated from the terminals on the human body becomes an important issue. The influence of electromagnetic waves at a frequency band used by portable terminals on the human body is not clearly known now, but it has been reported that the electromagnetic waves may cause leukemia, a brain tumor, a headache, a lowering of eyesight, and confusion of brain waves, destruction of men's reproductive function, and various diseases, when they are accumulated in the human body. Thus, many researches for blocking electromagnetic waves to prevent the bad influences of the electromagnetic waves on the human body are underway.

Generally, electromagnetic wave absorbers absorb electromagnetic waves using a material having an electromagnetic wave absorbing characteristics, and thus prevent the above influence of the electromagnetic waves. These electromagnetic wave absorbers are developed by a trial and error method, and thus have a complicated manufacturing process and cause a difficulty in adjusting an absorbing frequency band and absorbing characteristics.

Flat panel-type resonant electromagnetic wave absorbers, such as a $\lambda/4$ wave absorber and a Salisbury screen, include a resistive sheet, a dielectric spacer, a metal conductive ground surface, and thus have a simple constitution, are easily manufactured, and are easy to adjust an absorption performance. However, these resonant absorbers are disadvantageous in that the thickness of the dielectric spacer from the metal conductive ground surface is at least $\lambda/4$.

Accordingly, an electromagnetic wave absorber, which has a simple manufacturing process, is easy to adjust an absorbing frequency band and absorbing characteristics, and has an adjustable thickness, is required.

SUMMARY OF THE INVENTION

Therefore, the present invention has been made in view of the above problems, and it is an object of the present invention to provide an electromagnetic wave absorber made of a resistive material using an Electromagnetic BandGap (EBG) structure, which has a simple manufacturing process, and easily adjusts an absorbing frequency band and absorbing characteristics by adjusting parameters, and has an adjustable thickness.

In accordance with one aspect of the present invention, the above and other objects can be accomplished by the electromagnetic wave absorber having at least two unit cells, which are periodically arranged, each of said at least two unit cells including a ground layer made of a metal conductor, a dielectric layer formed on the ground layer and a unit cell pattern made of a resistive material, and formed on the dielectric layer. The fundamental patch and the half cross dipole patches have different surface resistance values.

In accordance with another aspect of the present invention, there is provided the electromagnetic wave absorber including a ground layer made of a metal conductor, a dielectric layer formed on the ground layer, and a unit cell pattern made of a resistive material, and formed on the dielectric layer. The unit cell pattern includes a fundamental patch having a regular square shape, in which a rectangular recess is formed on the center of each of the respective sides, the fundamental patch being located at the center of each of the plurality of unit cell patterns, and half cross dipole patches, which are respectively disposed at the four sides of the fundamental patch at a regular angle so as to be engaged with the recesses formed on the respective sides of the fundamental patch at a regular interval. The unit cell pattern further includes a first slot formed in the center of the fundamental patch. The unit cell patterns includes second slots respectively having a regular square shape, and formed at corners of the first slot. The unit cell patterns include third slots respectively formed in the half cross dipole patches. The third slots respectively have a shape of a half cross dipole. The resonant frequency and the bandwidth of the electromagnetic wave absorber are controlled by adjusting structural parameters to determine the electrical lengths of the fundamental patch and the half cross dipole patches, an interval between the fundamental patch and the half cross dipole patches, a height from the ground layer to the plurality of unit cell patterns, material characteristics for the dielectric layer, surface resistance values of the plurality of unit cell patterns, a size of the first slot, a length of one side of each of the second slots, and a size of the third slots. The unit cell patterns of neighboring unit cells, periodically arranged, have different surface resistance values. The structural parameters to determine the electrical lengths of the fundamental patch and the half cross dipole patches include a length of one side of the unit cell pattern, a length of one side of each of the half cross dipole patches, which contacts the corresponding the unit cell pattern, a length of another side of each of the half cross dipole patches, which is engaged with the fundamental patch and is parallel with the fundamental patch, a length of one side of the regular square-shaped fundamental patch, a thickness of the unit cell patterns, and a perpendicular height of each of the half cross dipole patches from one side of the plurality of unit cell patterns.

BRIEF DESCRIPTION OF THE DRAWING

The above and other objects, features and other advantages of the present invention will be more clearly understood from the following detailed description taken in conjunction with the accompanying drawings, in which.

DETAILED DESCRIPTION OF THE EMBODIMENTS

Now, preferred embodiments of the present invention will be described in detail with reference to the annexed drawings.

Figure 1:
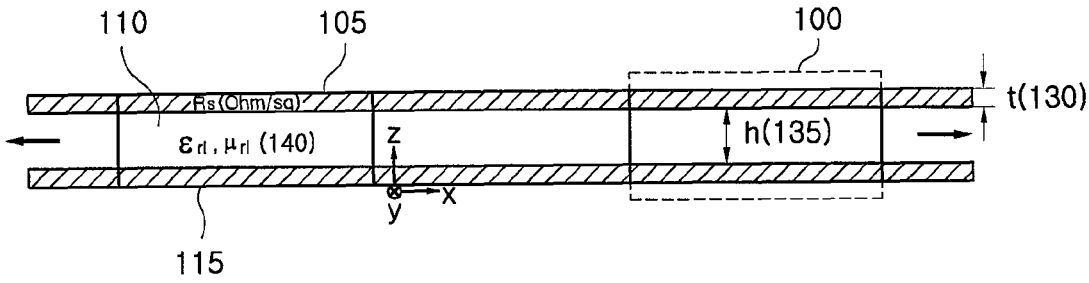
FIG. 1 is a front view of one embodiment of an electromagnetic wave absorber using a resistive material in accordance with the present invention.

FIG. 1 is a front view of one embodiment of an electromagnetic wave absorber using a resistive material in accordance with the present invention. With reference to FIG. 1, an electromagnetic wave absorber is obtained by periodically arranging unit cells 100 of an Electromagnetic BandGap (EBG), each of which includes a metal conductive ground surface 115, a dielectric layer 110 formed on the metal conductive ground surface 115, and a unit cell pattern 105 made of a resistive material and formed on the dielectric layer 110.

The dielectric layer 110 and the unit cell pattern 105 made of the resistive material form a structure adding a loss to a frequency selective surface (FSS), and thus serve to partially reflect and partially transmit incident waves at a desired frequency and to adjust phases of the waves in the dielectric layer 110. Further, the metal conductive ground surface 115 serves to totally reflect electromagnetic waves, partially transmitted by the unit cell pattern 105 made of the resistive material. And, the reflected electromagnetic waves interfere and cancel one another by adjusting the phases of the electromagnetic waves in the dielectric layer 110, and thus the electromagnetic wave absorber of the present invention absorbs the electromagnetic waves.

A height 135*h* of the unit cell pattern 105 from the metal conductive ground surface 115, properties of the permittivity 140$\in_{r1}$, and magnetic permeability 140$\mu_{r1}$ of the dielectric layer 110, and a thickness 130*t* of the unit cell pattern 105 serve as parameters of the absorption performance of the electromagnetic wave absorber, such that electromagnetic wave absorbing band and absorption performance of the electromagnetic wave absorber can be adjusted.

Figure 2:
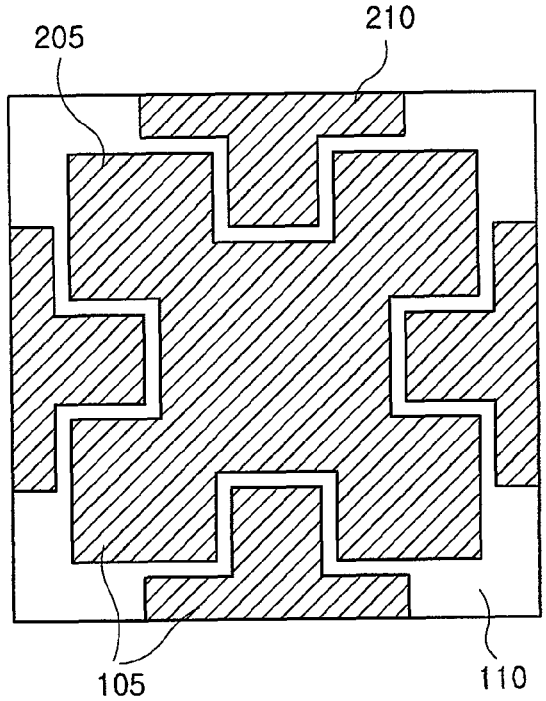
FIG. 2 is a plan view of one embodiment of a unit cell pattern structure of the electromagnetic wave absorber in accordance with the present invention.

FIG. 2 is a plan view of one embodiment of a unit cell pattern structure of the electromagnetic wave absorber in accordance with the present invention. With reference to FIG. 2, a unit cell pattern 105 of the electromagnetic wave absorber includes a fundamental patch 205 formed on the dielectric layer 110 and having a regular square shape, in which a rectangular recess is formed on the center of each of the respective sides, and half cross dipole patches 210, which are respectively disposed at the center of the four sides of the fundamental patch 205, formed in the center of the unit cell pattern 105, at a regular angle so as to be engaged with the recesses formed on the respective sides of the fundamental patch 205 at a regular interval. And, the half cross dipole patches may have generally 'T'-like shape.

Figure 3:
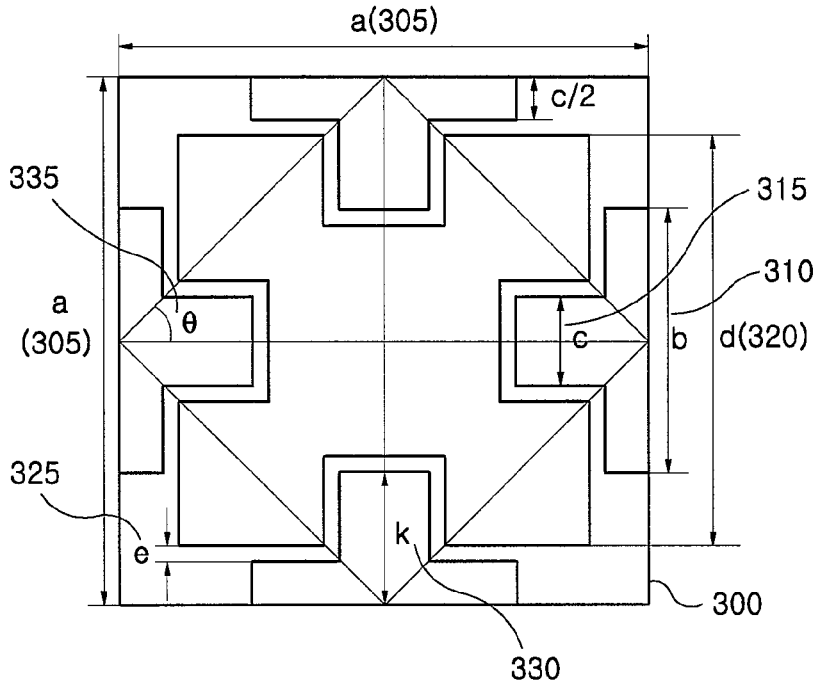
FIG. 3 is a view illustrating detailed design parameters of the unit cell pattern structure of FIG. 2.

FIG. 3 is a view illustrating detailed design parameters of the unit cell pattern structure of FIG. 2. With reference to FIG. 3, a length 305*a* of one side of the unit cell pattern, a length 310*b* of one side of the half cross dipole patch, which contacts the unit cell pattern, a length 315*c* of another side of the half cross dipole patch, which is engaged with the fundamental patch and is parallel with the fundamental patch, a length 320*d* of one side of the regular square-shaped fundamental patch, an interval 325*e* between the fundamental patch and the half cross dipole patch, a perpendicular height 330*k* of the half cross dipole patch from one side of the unit cell pattern, and an angle 335θ between a line, connecting the center of one side of the half cross dipole patch contacting the unit cell pattern and the center of one side of the neighboring half cross dipole patch contacting the unit cell pattern, and a line, connecting the center of the side of the half cross dipole patch contacting the unit cell pattern and the center of one side of the opposite half cross dipole patch contacting the unit cell pattern, are parameters of the electromagnetic wave absorber, which serve to adjust an absorbing bandwidth and an absorbing performance of the electromagnetic wave absorber. The structural parameters to determine the electrical lengths of the fundamental patch and the half cross dipole patches include a length of one side of the unit cell patterns, a length of one side of the half cross dipole patches which contacts the corresponding one of the plurality of unit cell patterns, a length of another side of each of the half cross dipole patches which is engaged with the fundamental patch and is parallel with the fundamental patch, a length of one side of the regular square-shaped fundamental patch, a thickness of the plurality of unit cell patterns, and a perpendicular height of each of the half cross dipole patches from one side of the unit cell patterns.

Figure 4:
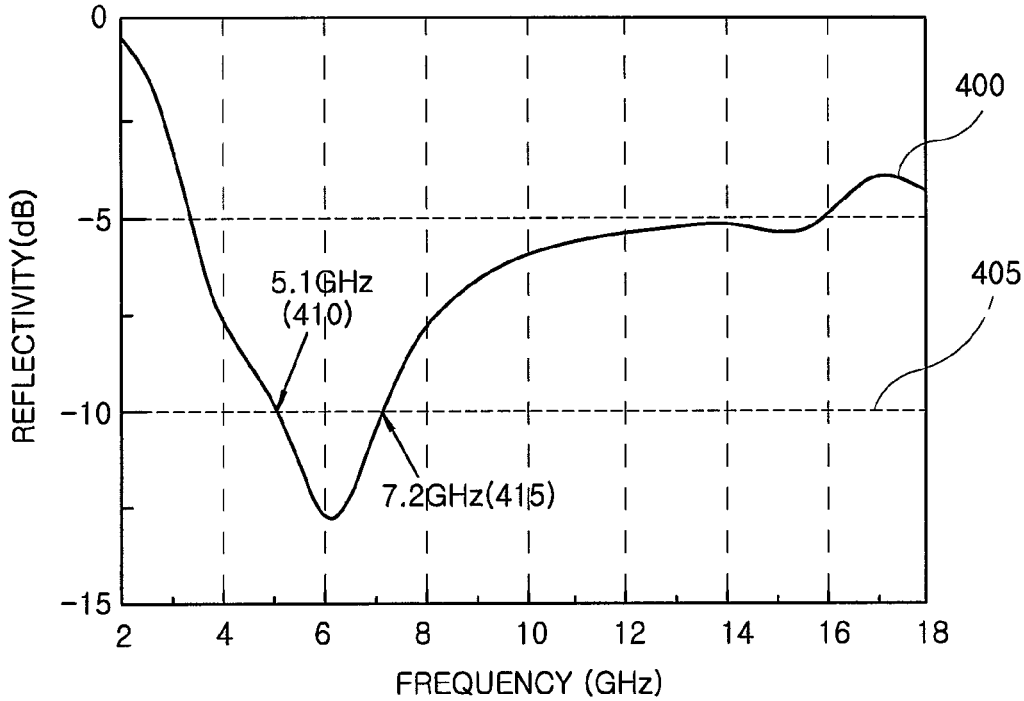
FIG. 4 is a graph illustrating a variation of an electromagnetic wave absorbing band and a variation of an electromagnetic wave absorbing performance of the electromagnetic wave absorber having the unit cell pattern structure of FIG. 2.

FIG. 4 is a graph illustrating a variation of an electromagnetic wave absorbing band and a variation of an electromagnetic wave absorbing performance of the electromagnetic wave absorber having the unit cell pattern structure of FIG. 2. FIG. 4 illustrates a variation of reflectivity 400 according to a variation of a frequency band of electromagnetic waves incident upon the electromagnetic wave absorber having the structure of the unit cell pattern of FIG. 2, when a surface resistance (Rs) of the unit cell pattern is 40 ohm/sq, and the parameters of FIG. 3 have designated values, such as 305*a*=30 mm, 310*b*=15 mm, 315*c*=5 mm, 320*d*=23 mm, 325*e*=1 mm, 135*h*=5 mm, 330*k*=7.5 mm, 130*t*=0.001 mm, 335θ=45°, 140$\in_r$=1, and 140$\mu_r$=1. Here, reflectivity is defined as follows.

$$R(\text{dB})=20\times\log(r_{DUT}/r_G)$$

Here, R represents reflectivity, $r_{DUT}$ represents a reflection coefficient of the electromagnetic wave absorber, and $r_G$ represents a reflection coefficient of the metal conductive ground surface. In the present invention, an absorbing band of −10 dB is decided to be a reference line 405. A frequency band having a reflectivity less than the reference line 405 of −10 dB is in the range of 5.1 GHz (410) to 7.2 GHz (415), and thus the frequency band in one embodiment is 5.1 GHz to 7.2 GHz.

Figure 5:
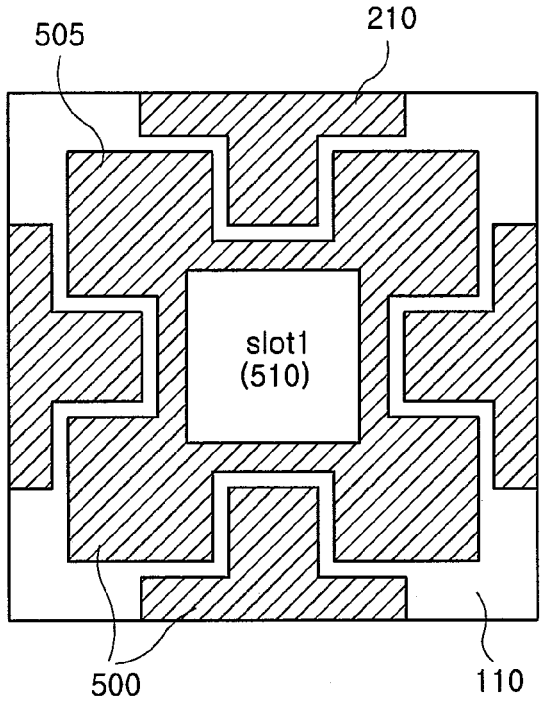
FIG. 5 is a plan view of another embodiment of the unit cell pattern structure of the electromagnetic wave absorber in accordance with the present invention.

FIG. 5 is a plan view of another embodiment of the unit cell pattern structure of the electromagnetic wave absorber in accordance with the present invention. With reference to FIG. 5, a unit cell pattern 500 of the electromagnetic wave absorber includes a fundamental patch 505 formed on the dielectric layer 110 and having a regular square shape, in which a rectangular recess is formed on the center of each of the respective sides, half cross dipole patches 210, which are respectively disposed at the center of the four sides of the fundamental patch 505, formed in the center of the unit cell pattern 500, at a regular angle so as to be engaged with the recesses formed on the respective sides of the fundamental patch 505 at a regular interval, and a first slot 510 located at the center of the fundamental patch 505.

By adjusting the size of the first slot 510, the first slot 510 serves to adjust an absorbing bandwidth and an absorbing performance of the electromagnetic wave absorber.

Figure 6:
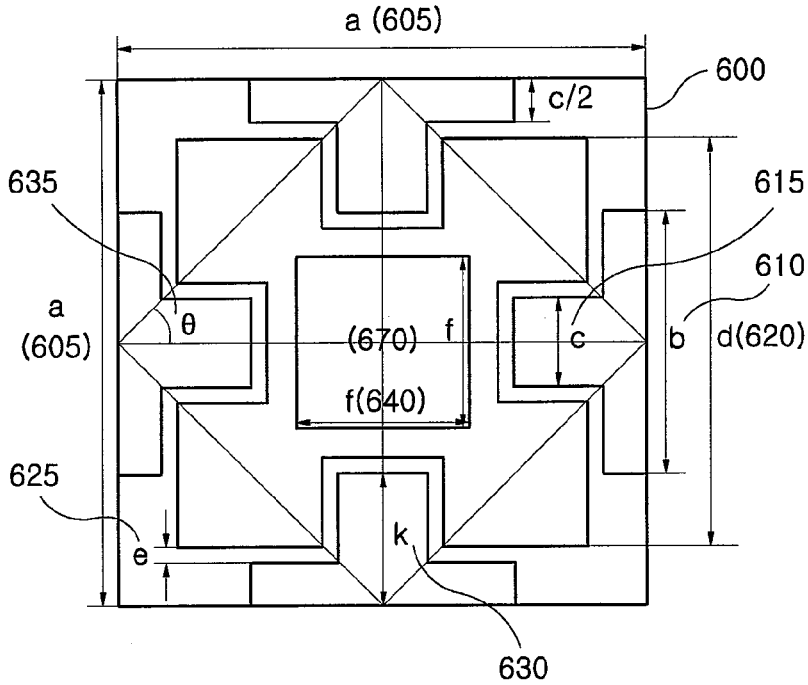
FIG. 6 is a view illustrating detailed design parameters of the unit cell pattern structure of FIG. 5.

FIG. 6 is a view illustrating detailed design parameters of the unit cell pattern structure of FIG. 5. With reference to FIG. 6, a length 605*a* of one side of the unit cell pattern, a length 610*b* of one side of the half cross dipole patch, which contacts the unit cell pattern, a length 615*c* of another side of the half cross dipole patch, which is engaged with the fundamental patch and is parallel with the fundamental patch, a length 620*d* of one side of the regular square-shaped fundamental patch, an interval 625*e* between the fundamental patch and the half cross dipole patch, a perpendicular height 630*k* of the half cross dipole patch from one side of the unit cell pattern, an angle 635θ between a line, connecting the center of one side of the half cross dipole patch contacting the unit cell pattern and the center of one side of the neighboring half cross dipole patch contacting the unit cell pattern, and a line, connecting the center of the side of the half cross dipole patch contacting the unit cell pattern and the center of one side of the opposite half cross dipole patch contacting the unit cell pattern, and a size 640*f* of the first slot 510 are parameters of the electromagnetic wave absorber, which serve to adjust an absorbing bandwidth and an absorbing performance of the electromagnetic wave absorber.

Figure 7:
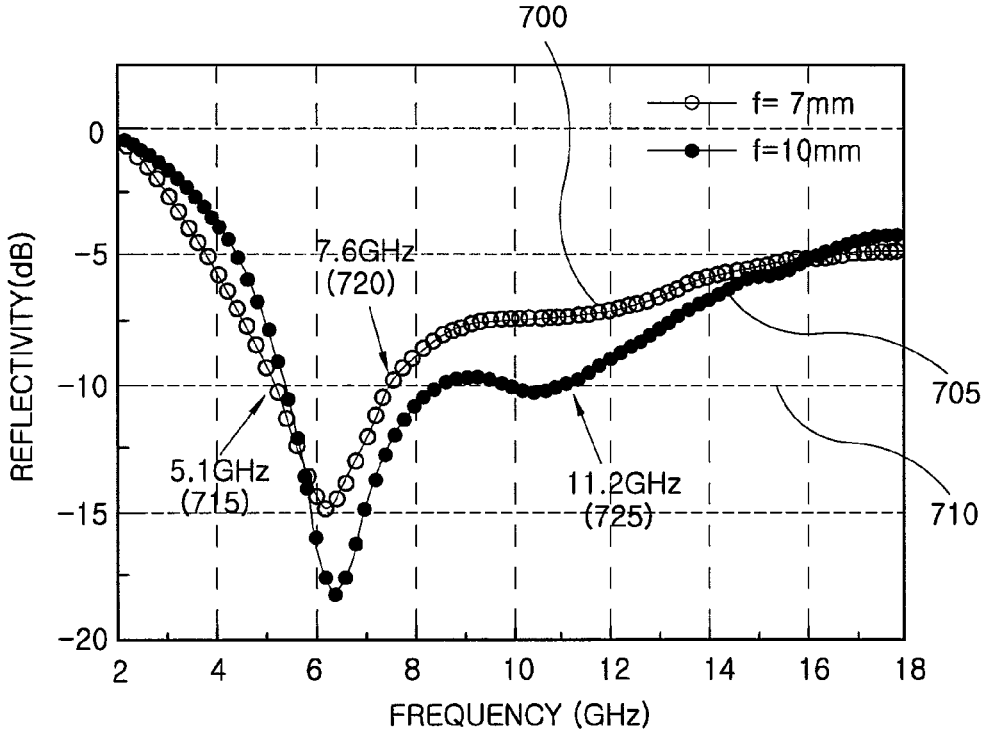
FIG. 7 is a graph illustrating a variation of an electromagnetic wave absorbing band and a variation of an electromagnetic wave absorbing performance of the electromagnetic wave absorber having the unit cell pattern structure of FIG. 5 according to a variation of a size of a first slot.

FIG. 7 is a graph illustrating a variation of an electromagnetic wave absorbing band and a variation of an electromagnetic wave absorbing performance of the electromagnetic wave absorber having the unit cell pattern structure of FIG. 5 according to values of the parameters of FIG. 6. With reference to FIG. 7, two curves 700 and 705 have the same parameter values, such as Rs=40 ohm/sq, 605*a*=30 mm, 610*b*=15 mm, 615*c*=5 mm, 620*d*=23 mm, 625*e*=1 mm, 135*h*=5 mm, 630*k*=7.5 mm, 130*t*=0.001 mm, 635θ=45°, 140$\in_r$=1, and 140$\mu_r$=1. However, the curve 700 has a size 640*f* of the first slot, which is 7 mm, and the curve 705 has a size 640*f* of the first slot, which is 10 mm. A dotted line 710 is a reference line to determine an absorbing band. The curve having 640*f*=7 mm has a bandwidth in the range of 5.1 GHz (715) to 7.6 GHz (720), and the curve having 640*f*=10 mm has a bandwidth in the range of 5.1 GHz (715) to 11.2 GHz (725). It is shown that the first slot increases the bandwidth of reflectivity and the absorbing level, the absorbing performance is easily controlled by adjusting the size of the first slot, and the curve 705 has a better absorbing performance at a resonant frequency than that of the curve 700.

Figure 8:
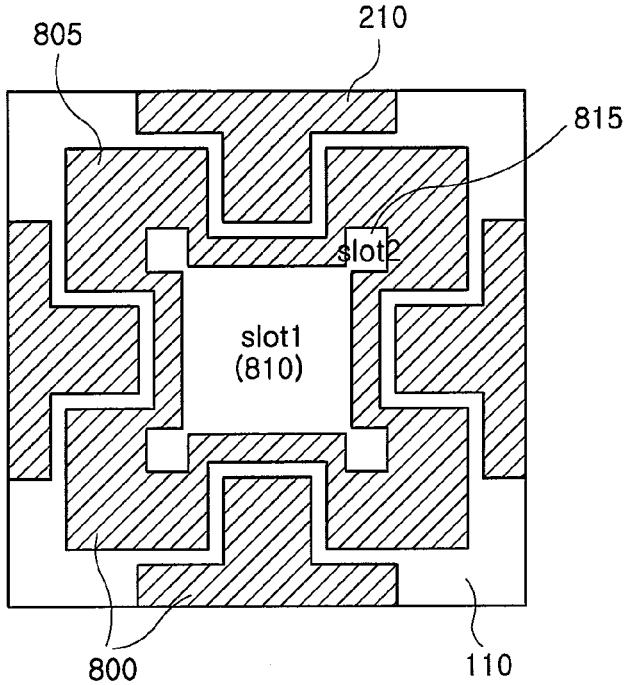
FIG. 8 is a plan view of another embodiment of the unit cell pattern structure of the electromagnetic wave absorber in accordance with the present invention.

FIG. 8 is a plan view of another embodiment of the unit cell pattern structure of the electromagnetic wave absorber in accordance with the present invention. With reference to FIG. 8, a unit cell pattern 800 of the electromagnetic wave absorber includes a fundamental patch 805 formed on the dielectric layer 110 and having a regular square shape, in which a rectangular recess is formed on the center of each of the respective sides, half cross dipole patches 210, which are respectively disposed at the center of the four sides of the fundamental patch 805, formed in the center of the unit cell pattern 800, at a regular angle so as to be engaged with the recesses formed on the respective sides of the fundamental patch 805 at a regular interval, a first slot 810 located at the center of the fundamental patch 805, and second slots 815 respectively formed at corners of the first slot 810 and having a regular square shape.

By adjusting the size of the second slots 815, the second slots 815 serve to adjust an absorbing bandwidth and an absorbing performance of the electromagnetic wave absorber, together with the first slot 810.

Figure 9:
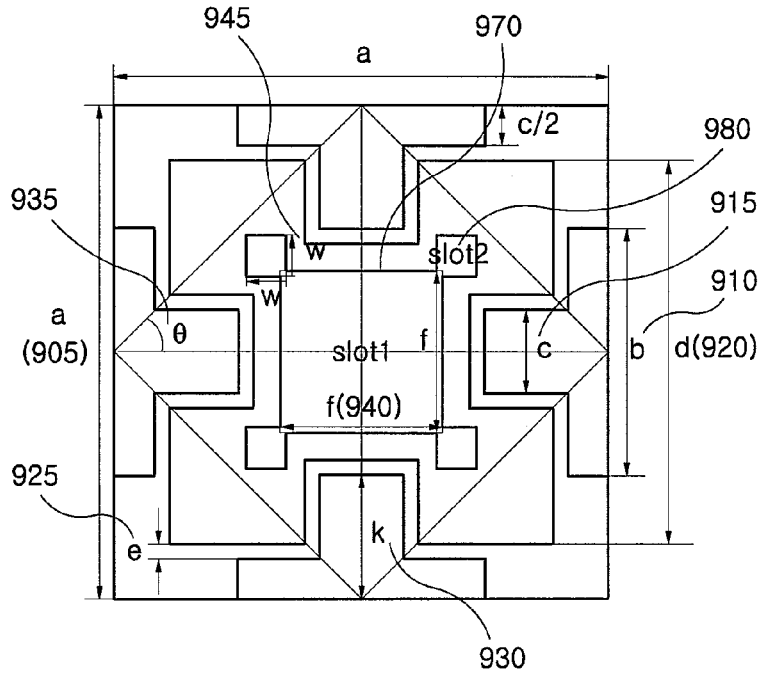
FIG. 9 is a view illustrating detailed design parameters of the unit cell pattern structure of FIG. 8.

FIG. 9 is a view illustrating detailed design parameters of the unit cell pattern structure of FIG. 8. With reference to FIG. 9, a length 905*a* of one side of the unit cell pattern, a length 910*b* of one side of the half cross dipole patch, which contacts the unit cell pattern, a length 915*c* of another side of the half cross dipole patch, which is engaged with the fundamental patch and is parallel with the fundamental patch, a length 920*d* of one side of the regular square-shaped fundamental patch, an interval 925*e* between the fundamental patch and the half cross dipole patch, a perpendicular height 930*k* of the half cross dipole patch from one side of the unit cell pattern, an angle 935θ between a line, connecting the center of one side of the half cross dipole patch contacting the unit cell pattern and the center of one side of the neighboring half cross dipole patch contacting the unit cell pattern, and a line, connecting the center of the side of the half cross dipole patch contacting the unit cell pattern and the center of one side of the opposite half cross dipole patch contacting the unit cell pattern, a size 940*f* of the first slot, and a length 945*w* of one side of each of the second slots are parameters of the electromagnetic wave absorber, which serve to adjust an absorbing bandwidth and an absorbing performance of the electromagnetic wave absorber.

Figure 10:
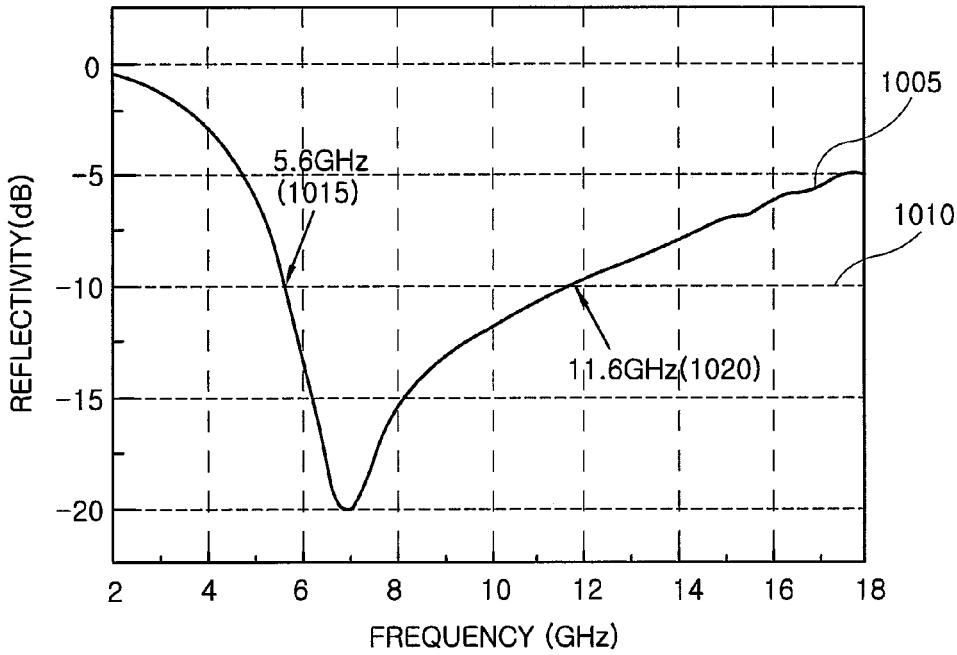
FIG. 10 is a graph illustrating a variation of an electromagnetic wave absorbing band and a variation of an electromagnetic wave absorbing performance of the electromagnetic wave absorber having the unit cell pattern structure of FIG. 8.

FIG. 10 is a graph illustrating a variation of an electromagnetic wave absorbing band and a variation of an electromagnetic wave absorbing performance of the electromagnetic wave absorber having the unit cell pattern structure of FIG. 8. A portion of a curve 1005, which is located below a reference line 1010, illustrates a variation of the bandwidth of the absorber from 5.6 GHz (1015) to 11.6 GHz (1020).

Figure 11:
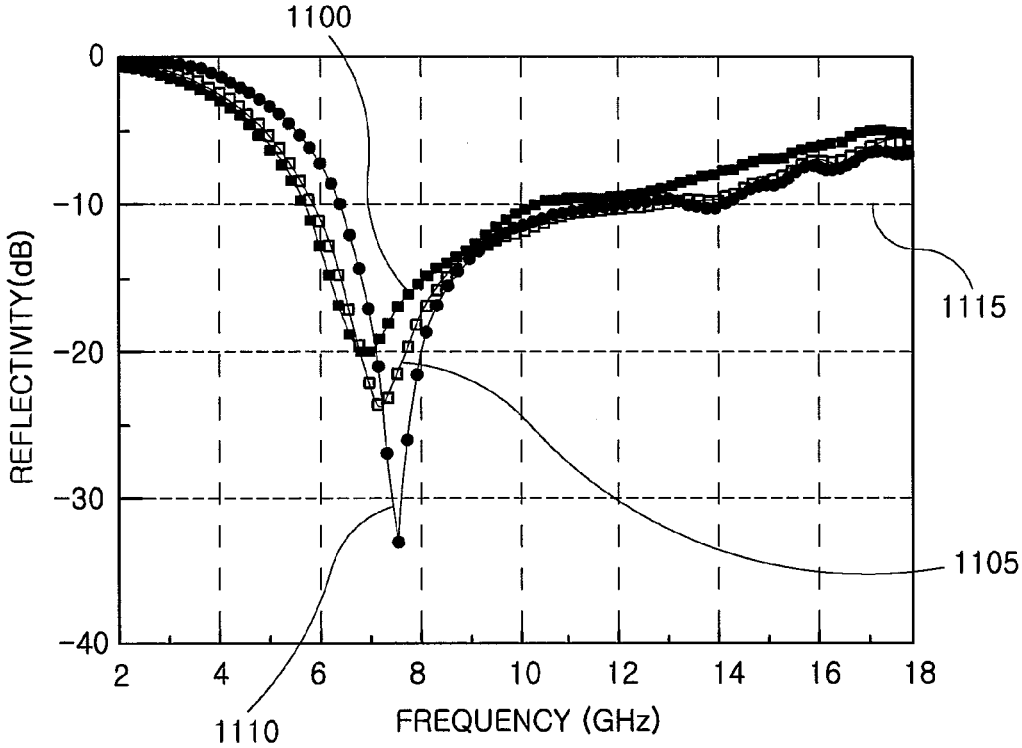
FIG. 11 is a graph illustrating a variation of an electromagnetic wave absorbing band and a variation of an electromagnetic wave absorbing performance of the electromagnetic wave absorber having the unit cell pattern structure of FIG. 9 according to a variation of a length of sides of second slots.

FIG. 11 is a graph illustrating a variation of an electromagnetic wave absorbing band and a variation of an electromagnetic wave absorbing performance of the electromagnetic wave absorber having the unit cell pattern structure of FIG. 8 according to values of the parameters of FIG. 9. Three curves 1100, 1105, and 1110 have the same parameter values, such as Rs=40 ohm/sq, 905*a*=30 mm, 910*b*=15 mm, 915*c*=5 mm, 920*d*=23 mm, 925*e*=1 mm, 135*h*=5 mm, 930*k*=7.5 mm, 130*t*=0.001 mm, 935θ=45°, 140$\epsilon_r$=1, 140$\mu_r$=1, and 940*f*=10 mm. However, the curve 1100 has a length 945*w* of one side of each of the second slots, which is 2.5 mm, the curve 1105 has a length 945*w* of one side of each of the second slots, which is 3.5 mm, and the curve 1110 has a length 945*w* of one side of each of the second slots, which is 6.5 mm. A dotted line 1115 is a reference line to determine an absorbing bandwidth. It is shown that the bandwidth and the absorbing performance at a resonant frequency are varied according to values of the length 945*w* of one side of each of the second slots.

Figure 12:
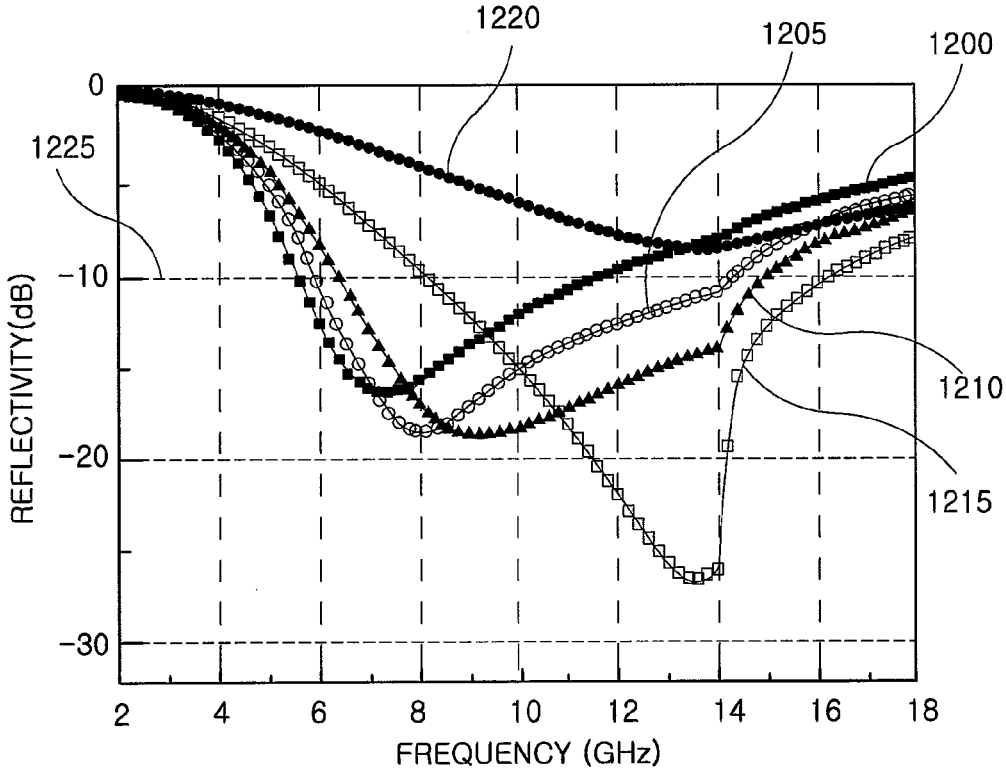
FIG. 12 is a graph illustrating a variation of an electromagnetic wave absorbing band and a variation of an electromagnetic wave absorbing performance of the electromagnetic wave absorber having the unit cell pattern structure of FIG. 9 according to a variation of a surface resistance.

FIG. 12 is a graph illustrating a variation of an electromagnetic wave absorbing band and a variation of an electromagnetic wave absorbing performance of the electromagnetic wave absorber having the unit cell pattern structure of FIG. 8 according to values of the parameters of FIG. 9. Five curves 1200, 1205, 1210, 1215, and 1220 have the same parameter values, such as 905*a*=30 mm, 910*b*=15 mm, 915*c*=5 mm, 920*d*=23 mm, 925*e*=1 mm, 135*h*=5 mm, 930*k*=7.5 mm, 130*t*=0.001 mm, 935θ=45°, 140$\epsilon_r$=1, 140$\mu_r$=1, 940*f*=10 mm, and 945*w*=2.5 mm. However, the curve 1200 has a surface resistance (Rs), which is 40 ohm/sq, the curve 1205 has a surface resistance (Rs), which is 60 ohm/sq, the curve 1210 has a surface resistance (Rs), which is 80 ohm/sq, the curve 1215 has a surface resistance (Rs), which is 150 ohm/sq, and the curve 1220 has a surface resistance (Rs), which is 377 ohm/sq. A dotted line 1225 is a reference line to determine an absorbing bandwidth. It is shown that the bandwidth and the absorbing performance at a resonant frequency are varied according to values of the surface resistance (Rs).

Figure 13:
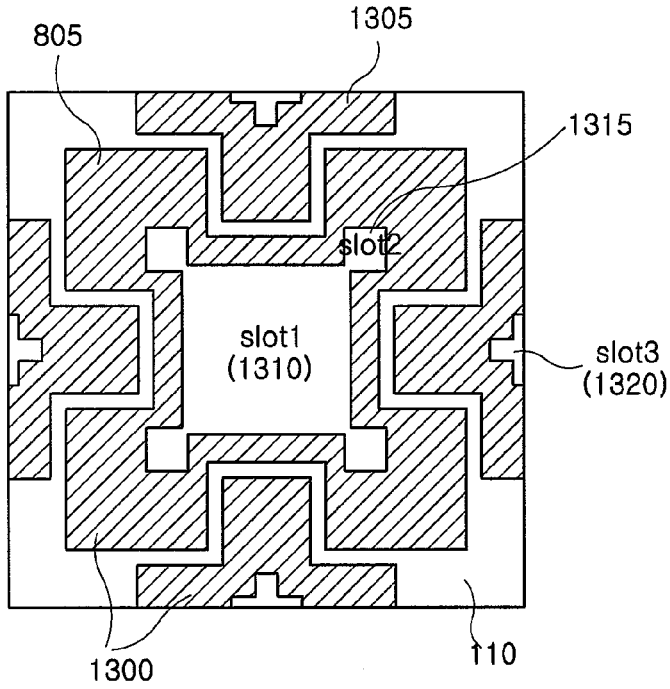
FIG. 13 is a plan view of another embodiment of the unit cell pattern structure of the electromagnetic wave absorber in accordance with the present invention.

FIG. 13 is a plan view of another embodiment of the unit cell pattern structure of the electromagnetic wave absorber in accordance with the present invention. With reference to FIG. 13, a unit cell pattern 1300 of the electromagnetic wave absorber includes a fundamental patch 805 formed on the dielectric layer 110 and having a regular square shape, in which a rectangular recess is formed on the center of each of the respective sides, half cross dipole patches 1305, which are respectively disposed at the center of the four sides of the fundamental patch 805 which is formed in the center of the unit cell pattern 1300 at a regular angle so as to be engaged with the recesses formed on the respective sides of the fundamental patch 805 at a regular interval, a first slot 1310 located at the center of the fundamental patch 805, second slots 1315 respectively formed at corners of the first slot 1310 and having a regular square shape, and third slots 1320 respectively formed in the half cross dipole patches 1305 and having any shape. For example, the third slots 1320 may respectively have the shape of a half cross dipole (a generally T-like shape) like the half cross dipole patch 1305.

The size of the third slots 1320 is adjusted, and thus the third slots 1320 serve to adjust the absorbing bandwidth and an absorbing performance of the electromagnetic wave absorber, together with the first slot 1310 and the second slots 1315.

Figure 14:
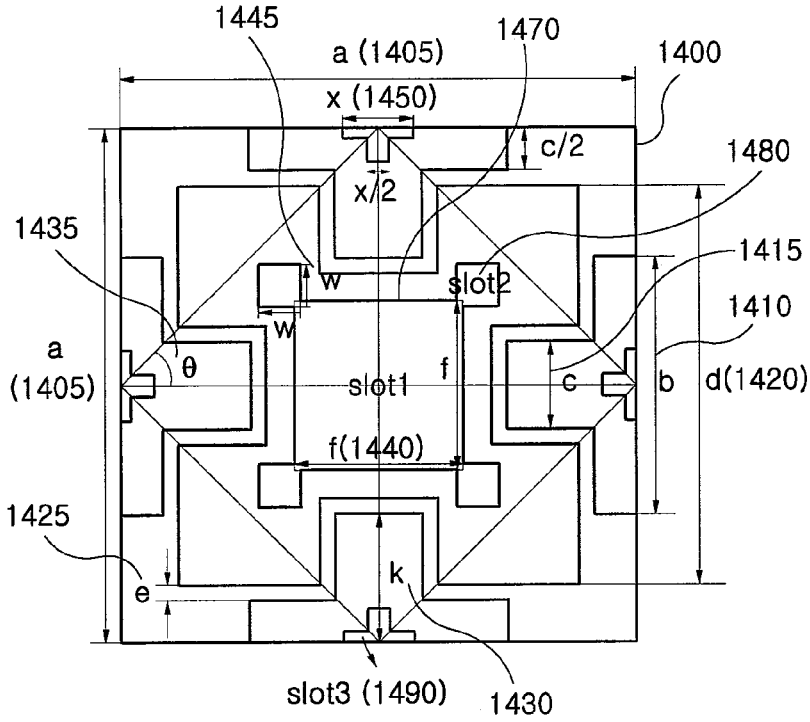
FIG. 14 is a view illustrating detailed design parameters of the unit cell pattern structure of FIG. 13.

FIG. 14 is a view illustrating detailed design parameters of the unit cell pattern structure of FIG. 13. With reference to FIG. 14, a length 1405*a* of one side of the unit cell pattern, a length 1410*b* of one side of the half cross dipole patch, which contacts the unit cell pattern, a length 1415*c* of another side of the half cross dipole patch, which is engaged with the fundamental patch and is parallel with the fundamental patch, a length 1420*d* of one side of the regular square-shaped fundamental patch, an interval 1425*e* between the fundamental patch and the half cross dipole patch, a perpendicular height 1430*k* of the half cross dipole patch from one side of the unit cell pattern, an angle 1435θ between a line, connecting the center of one side of the half cross dipole patch contacting the unit cell pattern and the center of one side of the neighboring half cross dipole patch contacting the unit cell pattern, and a line, connecting the center of the side of the half cross dipole patch contacting the unit cell pattern and the center of one side of the opposite half cross dipole patch contacting the unit cell pattern, a size 1440*f* of the first slot, a length 1445*w* of one side of each of the second slots, and a size 1450*x* of the third slots are parameters of the electromagnetic wave absorber, which serve to adjust an absorbing bandwidth and an absorbing performance of the electromagnetic wave absorber.

Figure 15:
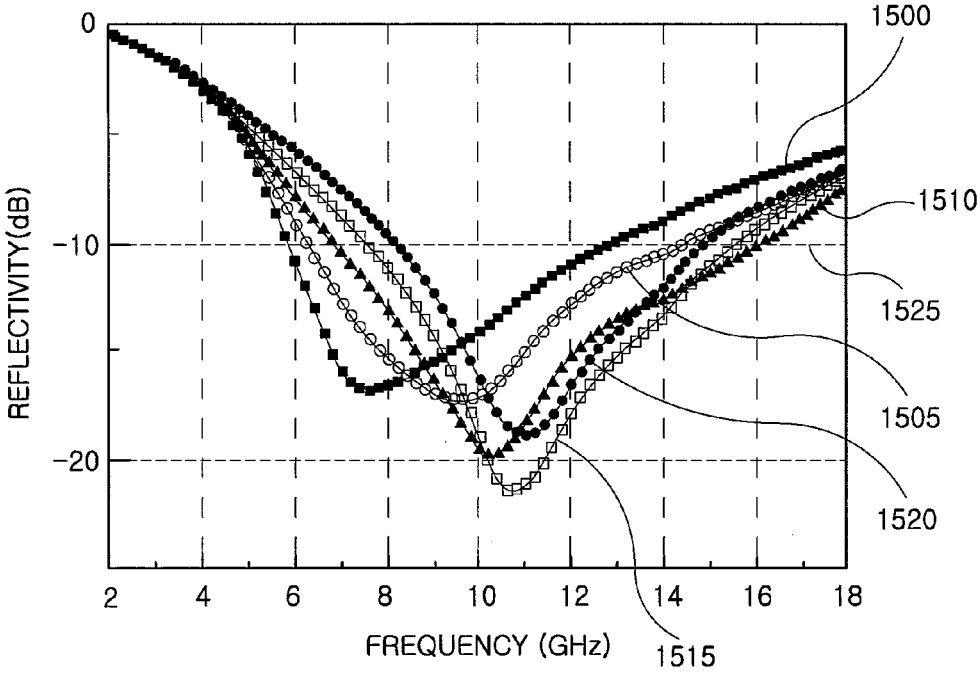
FIG. 15 is a graph illustrating a variation of an electromagnetic wave absorbing band and a variation of an electromagnetic wave absorbing performance of the electromagnetic wave absorber having the unit cell pattern structure of FIG. 13 according to a variation of a size of third slots.

FIG. 15 is a graph illustrating a variation of an electromagnetic wave absorbing band and a variation of an electromagnetic wave absorbing performance of the electromagnetic wave absorber having the unit cell pattern structure of FIG. 13 according to values of the parameters of FIG. 14. Five curves 1500, 1505, 1510, 1515, and 1520 have the same parameter values, 1405*a*=30 mm, 1410*b*=15 mm, 1415*c*=5 mm, 1420*d*=23 mm, 1425*e*=1 mm, 135*h*=5 mm, 1430*k*=7.5 mm, 130*t*=0.001 mm, 1435θ=45°, 140$\epsilon_r$=1, 140$\mu_r$=1, 1440*f*=10 mm, 1445*w*=2.5 mm, and Rs=40 ohm/sq. However, the curve 1500 has a size 1450*x* of the third slots, which is 2 mm, the curve 1505 has a size 1450*x* of the third slots, which is 3 mm, the curve 1510 has a size 1450*x* of the third slots, which is 4 mm, the curve 1515 has a size 1450*x* of the third slots, which is 5 mm, and the curve 1520 has a size 1450*x* of the third slots, which is 6 mm. A dotted line 1525 is a reference line to determine an absorbing bandwidth. It is shown that the bandwidth and the absorbing performance at a resonant frequency are varied according to values of the size 1450*x* of the third slots.

Figure 16:
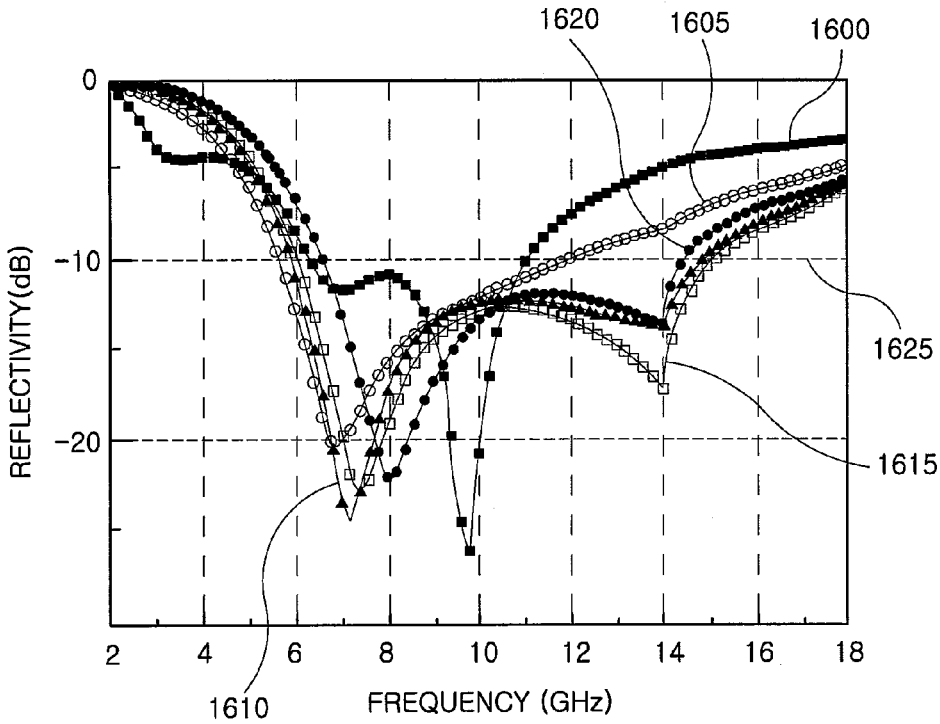
FIG. 16 is a graph illustrating a variation of an electromagnetic wave absorbing band and a variation of an electromagnetic wave absorbing performance of a hybrid electromagnetic wave absorber having a unit cell pattern structure, in which a fundamental patch and half cross dipole patches have different surface resistances, in accordance with the present invention according to a variation of a surface resistance of the fundamental patch.

FIG. 16 is a graph illustrating a variation of reflectivity according to a variation of a surface resistance of the fundamental patch in the structure of FIG. 8, in which the fundamental patch and the half cross dipole patches have different surface resistances. When the surface resistance of the half cross dipole patches is referred to Rs1 and the surface resistance of the fundamental patch provided with the first slot is referred to Rs2, five curves 1600, 1605, 1610, 1615, and 1620 have the same parameter values, such as 905*a*=30 mm, 910*b*=15 mm, 915*c*=5 mm, 920*d*=23 mm, 925*e*=1 mm, 135*h*=5 mm, 930*k*=7.5 mm, 130*t*=0.001 mm, 9350=45°, 140$\epsilon_r$=1, 140$\mu_r$=1, 940*f*=10 mm, 945*w*=2.5 mm, and Rs=40 ohm/sq. However, the curve 1600 has a surface resistance (Rs2) of the fundamental patch, which is 10 ohm/sq, the curve 1605 has a surface resistance (Rs2) of the fundamental patch, which is 40 ohm/sq, the curve 1610 has a surface resistance (Rs2) of the fundamental patch, which is 100 ohm/sq, the curve 1615 has a surface resistance (Rs2) of the fundamental patch, which is 150 ohm/sq, and the curve 1620 has a surface resistance (Rs2) of the fundamental patch, which is 377 ohm/sq.

A dotted line 1625 is a reference line to determine an absorbing bandwidth. It is shown that this structure widens the absorbing bandwidth of the electromagnetic wave absorber and the bandwidth and the resonant frequency of the electromagnetic wave absorber are adjusted by the surface resistance of the fundamental patch.

Figure 17:
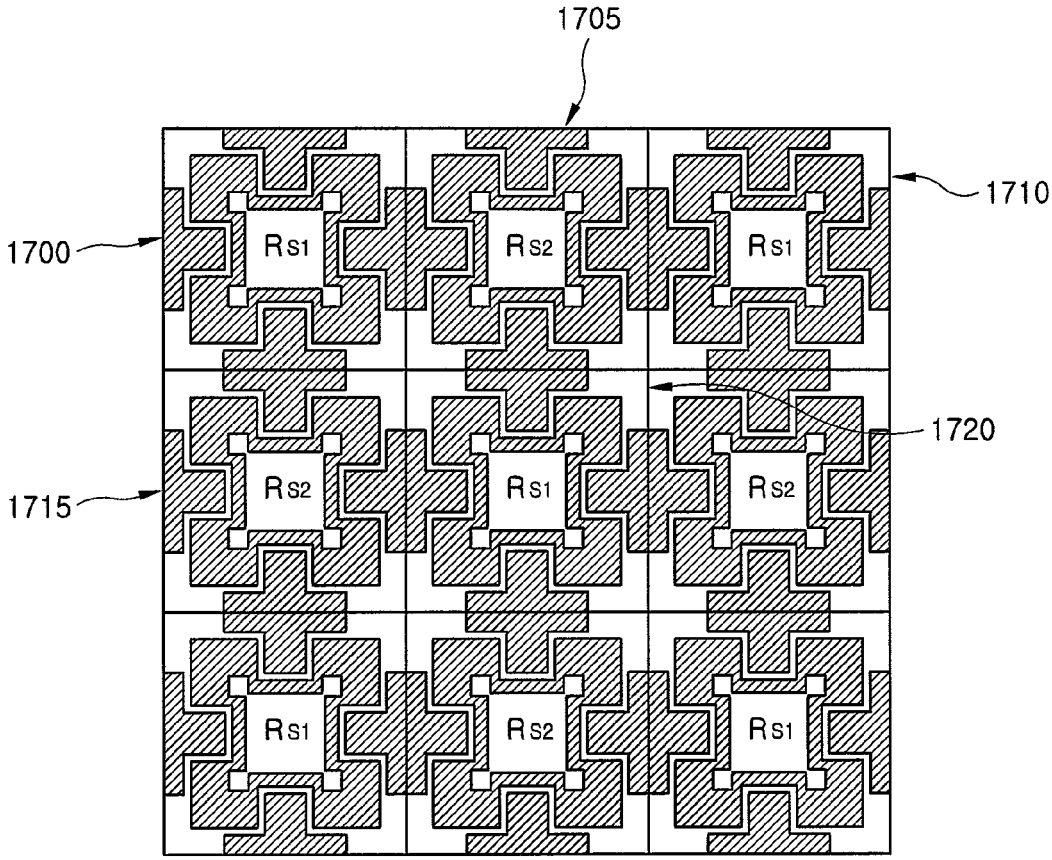
FIG. 17 is a plan view illustrating one embodiment of a unit cell pattern structure of the electromagnetic wave absorber, in which unit cell patterns are periodically arranged such that the neighboring unit cells patterns have different surface resistances.

FIG. 17 is a plan view illustrating one embodiment of a unit cell pattern structure of the electromagnetic wave absorber, in which unit cell patterns are periodically arranged such that the neighboring unit cells patterns have different surface resistances. In the embodiment of FIG. 17, unit cell patterns 1700 having a surface resistance (Rs1) and unit cell patterns 1705 having another surface resistance (Rs2) differing from the surface resistance (Rs1) are periodically arranged. That is, the unit cell patterns 1705 having the surface resistance (Rs2) are located at positions adjacent to the sides of the unit cell pattern 1700 having the surface resistance (Rs1), and the unit cell patterns 1700 having the surface resistance (Rs1) are located at positions adjacent to the sides of the unit cell pattern 1705 having the surface resistance (Rs2).

The above pattern structure, in which a desired number of the unit cell patterns are arranged, improves the absorbing bandwidth of the electromagnetic wave absorber, and the bandwidth and the resonant frequency of the electromagnetic wave absorber care adjusted by adjusting the surface resistance values of the above structure.

As apparent from the above description, the present invention provides an electromagnetic wave absorber having at least two unit cells, which are periodically arranged, each of the at least two unit cells comprising a ground layer made of a metal conductor; a dielectric layer formed on the ground layer; and a unit cell pattern made of a resistive material, and formed on the dielectric layer. The electromagnetic wave absorber is capable of estimating a performance, has a simple manufacturing process compared with a general electromagnetic wave absorber, easily adjusts an absorbing frequency band and absorbing characteristics through adjusting parameters, and has an adjustable thickness compared with a conventional flat panel-type resonant electromagnetic wave absorber and thus is miniaturized.

While the invention has been shown and described with respect to the embodiments, it will be understood by those skilled in the art that various changes and modifications may be made without departing from the scope of the invention as defined in the following claims.

What is claimed is:

1. An electromagnetic wave absorber having a plurality of unit cells, each of the unit cells comprising:

a ground layer made of a metal conductor;

a dielectric layer formed on the ground layer; and a unit cell pattern made of a resistive material, and formed on the dielectric layer, wherein:

the unit cells are classified into at least two different types of unit cells, each of said different types being determined by surface resistance values of the unit cell patterns; and said different types of unit cells are alternately arranged, and unit cell patterns of neighboring unit cells have different surface resistance values from each other.

2. The electromagnetic wave absorber of claim 1, wherein:

said different types include a first type having a first surface resistance value and a second type having a second surface resistance value; and unit cells of the first type are arranged to alternate with unit cells of the second type.

3. The electromagnetic wave absorber of claim 1, wherein:

taken from a plan view, the plurality of unit cells are arranged to form a plurality of rows and a plurality of columns;

in each row, said different type of unit cells are alternately arranged;

in each column, said different type of unit cells are alternately arranged.

4. An electromagnetic wave absorber comprising:

a ground layer made of a metal conductor;

a dielectric layer formed on the ground layer; and a unit cell pattern made of a resistive material, and formed on the dielectric layer, wherein the unit cell pattern includes:

a fundamental patch having a regular square shape, in which a rectangular recess is formed on the center of each of the respective sides, the fundamental patch being located at the center of each of the unit cell pattern; and half cross dipole patches, which are respectively disposed at the four sides of the fundamental patch at a regular angle so as to be engaged with the recesses formed on the respective sides of the fundamental patch at a regular interval.

5. The electromagnetic wave absorber of claim 4, wherein the resonant frequency and the bandwidth of the electromagnetic wave absorber are controlled by adjusting structural parameters to determine the electrical lengths of the fundamental patch and the half cross dipole patches, an interval between the fundamental patch and the half cross dipole patches, a height from the ground layer to the unit cell pattern, material characteristics for the dielectric layer, and surface resistance values of the unit cell pattern.

6. The electromagnetic wave absorber of claim 5, wherein the structural parameters to determine the electrical lengths of the fundamental patch and the half cross dipole patches include:

a length of one side of the unit cell pattern;

a length of one side of each of the half cross dipole patches, which contacts the corresponding the unit cell pattern;

a length of another side of each of the half cross dipole patches, which is engaged with the fundamental patch and is parallel with the fundamental patch;

a length of one side of the regular square-shaped fundamental patch;

a thickness of the unit cell patterns; and a perpendicular height of each of the half cross dipole patches from one side of the unit cell pattern.

7. The electromagnetic wave absorber of claim 4, wherein the unit cell pattern further includes a first slot formed in the center of the fundamental patch.

8. The electromagnetic wave absorber of claim 7, wherein the resonant frequency and the bandwidth of the electromagnetic wave absorber are controlled by adjusting structural parameters to determine the electrical lengths of the fundamental patch and the half cross dipole patches, an interval between the fundamental patch and the half cross dipole patches, a height from the ground layer to the unit cell pattern, material characteristics for the dielectric layer, surface resistance values of the unit cell pattern, and a size of the first slot.

9. The electromagnetic wave absorber of claim 8, wherein the structural parameters to determine the electrical lengths of the fundamental patch and the half cross dipole patches include:

a length of one side of the unit cell pattern;

a length of one side of each of the half cross dipole patches, which contacts the corresponding the unit cell pattern;

a length of another side of each of the half cross dipole patches, which is engaged with the fundamental patch and is parallel with the fundamental patch;

a length of one side of the regular square-shaped fundamental patch;

a thickness of the unit cell patterns; and a perpendicular height of each of the half cross dipole patches from one side of the of unit cell pattern.

10. The electromagnetic wave absorber of claim 7, wherein the unit cell pattern includes second slots respectively having a regular square shape, and formed at corners of the first slot.

11. The electromagnetic wave absorber of claim 10, wherein the resonant frequency and the bandwidth of the electromagnetic wave absorber are controlled by adjusting structural parameters to determine the electrical lengths of the fundamental patch and the half cross dipole patches, an interval between the fundamental patch and the half cross dipole patches, a height from the ground layer to the unit cell pattern, material characteristics for the dielectric layer, surface resistance values of the unit cell pattern, a size of the first slot, and a length of one side of each of the second slots.

12. The electromagnetic wave absorber of claim 11, wherein the structural parameters to determine the electrical lengths of the fundamental patch and the half cross dipole patches include:

a length of one side of the unit cell pattern;

a length of one side of each of the half cross dipole patches, which contacts the corresponding the unit cell pattern;

a length of another side of each of the half cross dipole patches, which is engaged with the fundamental patch and is parallel with the fundamental patch;

a length of one side of the regular square-shaped fundamental patch;

a thickness of the unit cell patterns; and a perpendicular height of each of the half cross dipole patches from one side of the unit cell pattern.

13. The electromagnetic wave absorber of claim 10, wherein the unit cell pattern includes third slots respectively formed in the half cross dipole patches.

14. The electromagnetic wave absorber of claim 13, wherein the third slots respectively have a shape of a half cross dipole.

15. The electromagnetic wave absorber of claim 13, wherein the resonant frequency and the bandwidth of the electromagnetic wave absorber are controlled by adjusting structural parameters to determine the electrical lengths of the fundamental patch and the half cross dipole patches, an interval between the fundamental patch and the half cross dipole patches, a height from the ground layer to the unit cell pattern, material characteristics for the dielectric layer, surface resistance values of the unit cell pattern, a size of the first slot, a length of one side of each of the second slots, and a size of the third slots.

16. The electromagnetic wave absorber of claim 15, wherein the structural parameters to determine the electrical lengths of the fundamental patch and the half cross dipole patches include:

a length of one side of the unit cell pattern;

a length of one side of each of the half cross dipole patches, which contacts the corresponding the unit cell pattern;

a length of another side of each of the half cross dipole patches, which is engaged with the fundamental patch and is parallel with the fundamental patch;

a length of one side of the regular square-shaped fundamental patch;

a thickness of the unit cell patterns; and a perpendicular height of each of the half cross dipole patches from one side of the unit cell pattern.

17. The electromagnetic wave absorber of claim 4, wherein the fundamental patch and the half cross dipole patches have different surface resistance values.

18. The electromagnetic wave absorber of claim 4, wherein the unit cell patterns of neighboring unit cells, periodically arranged, have different surface resistance values.

* * * * *